US007725323B2

(12) United States Patent
Padhi et al.

(10) Patent No.: US 7,725,323 B2
(45) Date of Patent: May 25, 2010

(54) DEVICE AND PROCESS FOR ENCODING AUDIO DATA

(75) Inventors: Kabi Prakash Padhi, Ann Arbor, MI (US); Sudhir Kumar Kasargod, Singapore (SG); Sapna George, Singapore (SG)

(73) Assignee: STMicroelectronics Asia Pacific Pte. Ltd., Singapore (SG)

( * ) Notice: Subject to any disclaimer, the term of this patent is extended or adjusted under 35 U.S.C. 154(b) by 1515 days.

(21) Appl. No.: 10/940,593

(22) Filed: Sep. 14, 2004

(65) Prior Publication Data

US 2005/0144017 A1 Jun. 30, 2005

(30) Foreign Application Priority Data

Sep. 15, 2003 (SG) ..... 200305637-1

(51) Int. Cl.
*G10L 19/00* (2006.01)

(52) U.S. Cl. ..... 704/500; 704/200.1; 704/501; 704/503; 704/504

(58) Field of Classification Search ..... 704/200.1, 704/500, 501, 504, 503
See application file for complete search history.

(56) References Cited

U.S. PATENT DOCUMENTS

RE39,080 E * 4/2006 Johnston ..... 704/200.1
7,027,982 B2 * 4/2006 Chen et al. ..... 704/230
2004/0024588 A1 * 2/2004 Watson et al. ..... 704/200.1

OTHER PUBLICATIONS

ISO/IEC 11172-3, "Information technology—Coding of moving pictures and associated audio for digital storage media at up to about 1.5 Mbit/s—Part 3: Audio", 1993, pp. v, 45,66, 71-76, 80, 92 and 98-109.*
Watkinson, "The MPEG Handbook" ISBN 0 240 80578, 2001-2005, pp. 192-219.*
OPTICOM, "Technical Specification for the OPERA Software Suite V3.0 OPR-000-XXX-S," 9 pages, 2001.

* cited by examiner

*Primary Examiner*—Qi Han
(74) *Attorney, Agent, or Firm*—Lisa K. Jorgenson; David V. Carlson

(57) ABSTRACT

An MPEG-1 layer 3 audio encoder, including a scalefactor generator for determining first scalefactors for encoding a block of audio data if a temporal masking transient is not detected in said block of audio data; and for selecting the maximum of said scalefactors for encoding said block of audio data if a temporal masking transient is detected in said block of audio data to enable greater compression of said audio data. Increases in quantization error, due to use of the maximum scalefactor are pre-masked or post-masked by the temporal masking transient. In cases where the last portion of a block includes a temporal masking transient that masks the preceding portions of the block, the maximum scalefactor is only used to encode the block if the resulting increase in quantization error is less than 30% of the quantization error for the block.

14 Claims, 4 Drawing Sheets

DEVICE AND PROCESS FOR ENCODING AUDIO DATA

BACKGROUND OF THE INVENTION

1. Field of the Invention

The present invention relates to a device and process for encoding audio data, and in particular to a process for determining encoding parameters for use in MPEG audio encoding.

2. Description of the Related Art

The MPEG-1 audio standard, as described in the International Standards Organization (ISO) document ISO/IEC 11172-3: Information technology—Coding of moving pictures and associated audio for digital storage media at up to about 1.5 Mbps ("the MPEG-1 standard"), defines processes for lossy compression of digital audio and video data. The MPEG-1 standard defines three alternative processes or "layers" for audio compression, providing progressively higher degrees of compression at the expense of increasing complexity. The third layer, referred to as MPEG-1-L3 or MP3, provides an audio compression format widely used in consumer audio applications. The format is based on a psychoacoustic or perceptual model that allows significant levels of data compression (e.g., typically 12:1 for standard compact disk (CD) digital audio data using 16-bit samples sampled at 44.1 kHz), whilst maintaining high quality sound reproduction, as perceived by a human listener. Nevertheless, it remains desirable to provide even higher levels of data compression, yet such improvements in compression are usually attended by an undesirable degradation in perceived sound quality. Accordingly, it is desired to address the above or at least to provide a useful alternative.

BRIEF SUMMARY OF THE INVENTION

In accordance with one aspect an embodiment provides a process for encoding audio data, including:

determining a first encoding parameter for encoding a block of audio data if a temporal masking transient is not detected in said block of audio data; and determining a second encoding parameter for encoding said block of audio data if a temporal masking transient is detected in said block of audio data, to enable greater compression of said audio data.

In accordance with another aspect, an embodiment provides a scalefactor generator for an audio encoder, said scalefactor generator adapted to generate scalefactors for use in quantizing respective portions of a block of audio data if a temporal masking transient is not detected in said block of audio data; and to select one of said scalefactors for use in quantizing each of said portions if a temporal masking transient is detected in said block of audio data to enable greater compression of said audio data.

In accordance with another aspect, an embodiment provides a scalefactor modifier for an audio encoder, said scalefactor modifier adapted to output scalefactors for use in quantizing respective portions of a block of audio data if a temporal masking transient is not detected in said block of audio data; and to select one of said scalefactors for use in quantizing each of said portions if a temporal masking transient is detected in said block of audio data to enable greater compression of said audio data.

In accordance with another aspect, an audio encoder comprises: an input preprocessor to receive a block of audio data and to detect a presence of a temporal masking transient in the block of audio data; psychoacoustic modeling circuitry coupled to the input preprocessor to generate masking data related to the block of audio data; and iteration loop circuitry, wherein the audio encoder is configured to: encode the block of data using a first protocol if a temporal masking transient is not detected in the block of audio data; encode the block of data using a second protocol if a temporal masking transient is detected in the block of audio data and a first criteria is satisfied; and selectively encode the block of data using a third protocol if a temporal masking transient is detected in the block of audio data and the first criteria is not satisfied.

In accordance with another aspect, a method of encoding a block of audio data comprises: encoding the block of data using a first protocol if a temporal masking transient is not detected in the block of audio data; encoding the block of data using a second protocol if a temporal masking transient is detected in the block of audio data and a first criteria is satisfied; and encoding the block of data using a third protocol if a temporal masking transient is detected in the block of audio data and the first criteria is not satisfied.

BRIEF DESCRIPTION OF THE DRAWINGS

Embodiments are hereinafter described, by way of example only, with reference to the accompanying drawings, wherein.

DETAILED DESCRIPTION OF THE INVENTION

Figure 1:
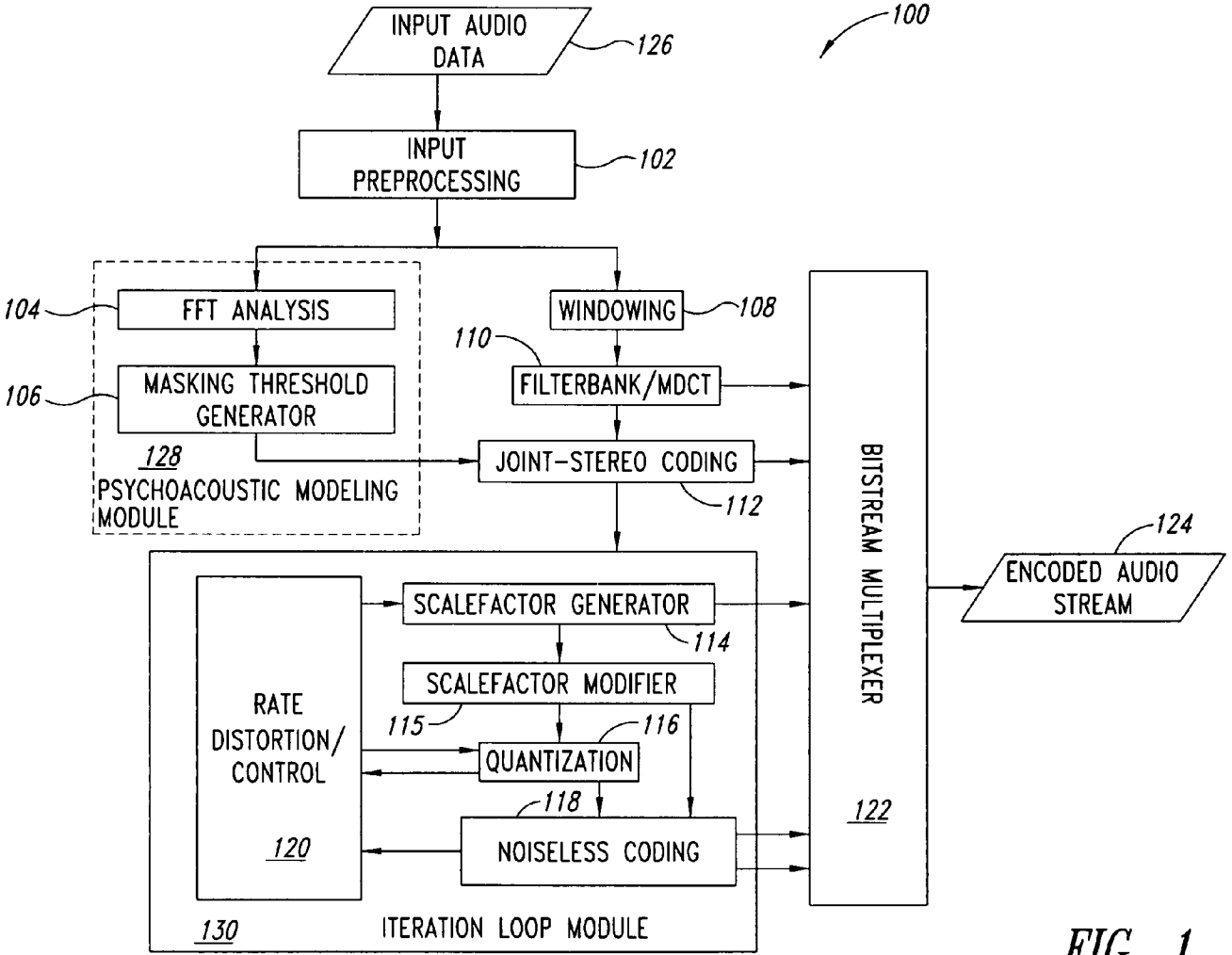
FIG. 1 is a functional block diagram of an embodiment of an audio encoder.

As shown in FIG. 1, an audio encoder 100 includes an input pre-processing module 102, a fast Fourier transform (FFT) analysis module 104, a masking threshold generator module 106, a windowing module 108, a filter bank and modified discrete cosine transform (MDCT) module 110, a joint stereo coding module 112, a scalefactor generator module 114, a scalefactor modifier module 115, a quantization module 116, a noiseless coding module 118, a rate distortion/control module 120, and a bit stream multiplexer module 122. The audio encoder 100 executes an audio encoding process that generates an encoded audio data stream 124 from an input audio data stream 126. The encoded audio data stream 124 constitutes a compressed representation of the input audio data stream 126.

The FFT analysis module 104 and the masking threshold generator module 106 together comprise a psychoacoustic modeling module 128. The scalefactor generator module 114, the scalefactor modifier module 115, the quantization module 116, the noiseless coding module 118, and the rate distortion/control module 120 together comprise an iteration loop module 130.

In the described embodiment, the audio encoder 100 may be a standard digital signal processor (DSP), such as a TMS320 series DSP manufactured by Texas Instruments, and the modules 102-122, 128-130 of the encoder 100 may be software modules stored in the firmware of the DSP-core. However, some or all of the audio encoding modules 102-

122, 128-130 could alternatively be implemented as dedicated hardware components such as application-specific integrated circuits (ASICs). Although the components of the audio encoder 100 are referred to as modules and will be separately identifiable as either software modules and/or circuitry in one embodiment, the components need not necessarily be separately identifiable in all embodiments and various functions may be combined and/or circuitry in an embodiment may perform one or more of the functions of the various modules. In some embodiments, a computer readable storage medium having stored thereon program code may be employed. For example, in an embodiment, a computer readable storage medium having stored thereon program code for executing the steps of: determining a first encoding parameter for encoding a block of audio data if a temporal masking transient is not detected in said block of audio data; and determining a second encoding parameter for encoding said block of audio data if a temporal masking transient is detected in said block of audio data to enable greater compression of said audio data, may be employed.

The audio encoding process executed by the encoder 100 performs encoding steps based on MPEG-1 layer 3 processes described in the MPEG-1 standard. The input audio data 126 may be a time-domain pulse code modulated (PCM) digital audio data, which may be of DVD quality, using a sample rate of 48,000 samples per second. As described in the MPEG-1 standard, the time-domain input audio data stream 126 is divided into 32 sub-bands and (modified) discrete cosine transformed by the filter bank and MDCT module 110, and the resulting frequency-domain (spectral) data undergoes stereo redundancy coding, as performed by the joint stereo coding module 112. The scalefactor generator module 114 then generates scalefactors that determine the quantization resolution, as described below, and the audio data is then quantized by the quantization module 116 using quantization parameters determined by the rate distortion/control module 120. The bit stream multiplexer module 122 then generates the encoded audio data or bit stream 124 from the quantized data.

The quantization module 116 performs bit allocation and quantization based upon masking data generated by the masking threshold generator 106. The masking data is generated from the input audio data stream 126 on the basis of a psychoacoustic model of human hearing and aural perception. The psychoacoustic modeling takes into account the frequency-dependent thresholds of human hearing, and a psychoacoustic phenomenon referred to as masking, whereby a strong frequency component close to one or more weaker frequency components tends to mask the weaker components, rendering them inaudible to a human listener. This makes it possible to omit the weaker frequency components when encoding audio data, and thereby achieve a higher degree of compression, without adversely affecting the perceived quality of the encoded audio data stream 124. The masking data comprises a signal-to-mask ratio value for each frequency sub-band. These signal-to-mask ratio values represent the amount of signal masked by the human ear in each frequency sub-band, and are therefore also referred to as masking thresholds. The quantization module 116 uses this information to decide how best to use the available number of data bits to represent the input audio data stream 126, as described in the MPEG-1 standard. Information describing how the available bits are distributed over the audio spectrum is included as side information in the encoded audio bit stream 124.

The MPEG-1 standard specifies the layer 3 encoding of audio data in long blocks comprising three groups of twelve samples (i.e., 36 samples) over the 32 sub-bands, making a total of 1152 samples. However, the encoding of long blocks gives rise to an undesirable artifact if the long block contains one or more sharp transients, for example, a period of silence followed by a percussive sound, such as from a castanet or a triangle. The encoding of a long block containing a transient can cause relatively large quantization errors which are spread across an entire frame when that frame is decoded. In particular, the encoding of a transient typically gives rise to a pre-echo, where the percussive sound becomes audible prior to the true transient. To alleviate this effect, the MPEG-1 standard specifies the layer 3 encoding of audio data using two block lengths: a long block of 1152 samples, as described above, and a short block of twelve samples for each sub-band, i.e., 12*32=384 samples. The short block is used when a transient is detected to improve the time resolution of the encoding process when processing transients in the audio data, thereby reducing the effects of pre-echo.

A psychoacoustic effect referred to as temporal masking can disguise such effects. In particular, the human auditory system is insensitive to low level sounds in a period of approximately 20 milliseconds prior to the appearance of a much louder sound. Similarly, a post-masking effect renders low level sounds inaudible for a period of up to 200 milliseconds after a comparatively loud sound. Accordingly, the use of short coding blocks for encoding transients can mask pre-echoes if the time spread is of the order of a few milliseconds. Furthermore, MPEG-1 layer 3 encoding processes control pre-echo by reducing the threshold of hearing used by the masking threshold generator module 106 when a transient is detected.

Figure 2:
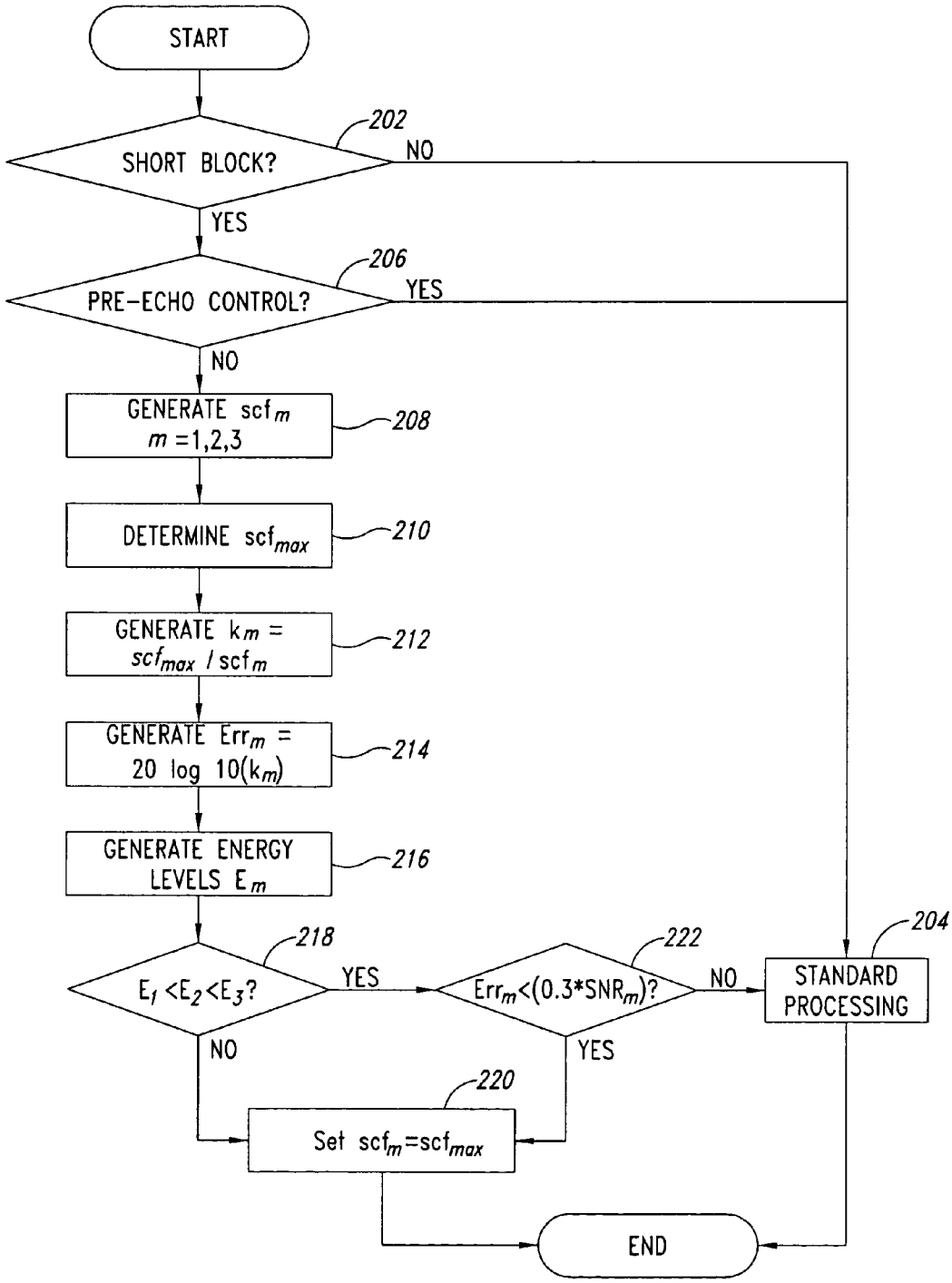
FIG. 2 is a flow diagram for an embodiment of a scalefactor generation process suitable for use by an audio encoder.

FIG. 2 illustrates a scalefactor generation process that can be employed by an audio encoder, such as the audio encoder 100 illustrated in FIG. 1. With reference to FIG. 1, the encoder 100 generates scalefactors for use by the quantization module 116 and the rate distortion/control module 120 to determine suitable quantization parameters for quantizing spectral components of the audio data. When encoding blocks of spectral data which do not contain appreciable transients, the data is encoded in long blocks of 1152 samples, as described above. The process begins at step 202 by determining whether the block of spectral data from the joint stereo coding module 112 is a long block or a short block, indicating whether a transient was detected by the input pre-processing module 102. If the block is a long block, and hence no transient was detected, standard processing is therefore performed at step 204. That is, scalefactors are generated by the scalefactor generator 114 in accordance with the MPEG-1 layer 3 standard. These scalefactors are then passed to the quantization module 116. Alternatively, if a short block has been passed to the scalefactor generator 114, then a test is performed at step 206 to determine whether standard pre-echo control, as described above, is to be used. If so, then the process performs standard processing at step 204. This involves limiting the value of the scalefactors to reduce transient pre-echo, as described in the MPEG-1 standard. Alternatively, if standard pre-echo control is not invoked at step 206, then three scalefactors $scf_m$, m=1, 2, 3 are generated by the scalefactor generator 114 at step 208 for three respective groups of twelve spectral coefficients generated by the filter bank and MDCT module 110.

At step 210, the scalefactor modifier 115 selects the greatest of these three scalefactors as $scf_{max}$. Thus instead of normalizing the three groups of spectral coefficients by their respective scalefactors, as per the MPEG-1 layer 3 standard, all three groups of coefficients can be normalized by the maximum scalefactor $scf_{max}$. The use of the maximum scalefactor reduces the dynamic range of the encoded spectral coefficients. The Huffman coding performed by the noiseless coding module 118 ensures that input samples which occur more often are assigned fewer bits. Consequently, quantization and coding of these smaller values results in fewer bits in the encoded audio data 124; i.e., greater compression.

However, normalizing by a greater scalefactor would also increase the quantization error. In particular, the signal-to-noise ratio for the $m^{th}$ spectral coefficient ($SNR_m$) is given by $$SNR_m = 10 \cdot \log \frac{P_s}{\kappa_m^2 P_n} = 10 \cdot \log \frac{P_s}{P_n} - 10 \cdot \log \kappa_m^2,$$

where $$\kappa_m = \frac{scf_{max}}{scf_m}$$

where $P_s$ is the signal power, and $P_n$ is the quantization noise power, given by;

$$P_n = \int_{-\Delta/2}^{\Delta/2} e^2 \cdot p(e) de$$

where, e represents the error, i.e., the difference between a true spectral coefficient and its quantized value, p(e) is the probability density function of the quantization error, and Δ is the quantizer step size. The value of Km is determined at step 212. In the case of linear quantizers, the error is uniformly distributed over a range −Δ/2 to +Δ/2, where Δ is the quantizer step size. A varies for power law quantizers, which are used in MPEG 1 Layer 3 encoders.

Accordingly, the degree of degradation $Err_m$ of the $SNR_m$ resulting from using the maximum scalefactor value is given by:

$$Err_m = 20. \log \kappa_m$$

This degree of degradation $Err_m$ is determined at step 214.

At step 216, the sound energy $E_m$, m=1, 2, 3 in each group of 12 samples is determined from the MDCT coefficients $X_m(k)$, as follows:

$$E_m = \sum_{k-1}^{12} X_m(k)^2,$$

The energy in each group is used to determine the duration of the temporal pre-masking and post-masking effects of the transient signal under consideration, as described below.

In a short block, the scalefactors are generated from the MDCT spectrum, which depends on the 12 samples output from each sub-band filter of the filter bank and MDCT module 110. In standard MP3 encoders, 3 sets of 12 samples are grouped together.

Applying the principles of temporal masking to short blocks, if the signal energy $E_2$ in the second group is higher than the signal energy E1 of the previous set of 12 samples, the effect of the first set of samples will be masked by the first set due to pre-masking. This is possible as 12 samples at a sampling rate of 48,000 samples per second corresponds to a period of 8 ms. Similarly, 24 samples correspond to 16 ms, which is smaller than the 20 ms pre-masking period.

In the human auditory system, post-masking is more dominant than pre-masking. Consequently, quantization errors are more likely to be perceived when relying on pre-masking. The worst cases occur when the third set of 12 samples is relied on to pre-mask the previous 24 samples. Consequently, a test is performed at step 218 to detect this situation by determining whether the energies of each group of 12 samples are in ascending order, i.e., whether $E_1<E_2<E_3$. If the energies of the 12 samples are not in ascending order, at step 220 the encoder 100 sets the scale modification factor to the maximum scale modification factor determined at step 210. If the energies of the 12 samples are in ascending order, then a further test is performed at step 222 by comparing the degradation $Err_m$ of the SNR that would result from using the maximum scalefactor to the SNR associated with quantization noise. If the noise $Err_m$ introduced by increasing the scalefactors is greater than 30% of the SNR, the encoder 100 performs standard processing at step 204; i.e., the respective scalefactors $scf_m$ are used, as per the MPEG-1 layer 3 standard. If the noise $Err_m$ introduced by increasing the scalefactors is not greater than 30% of the SNR, the encoder 100 proceeds to step 220 and sets the scale modification factor to the maximum scale modification factor determined at step 210. The encoder 100 may employ other error criteria. For example, another threshold percentage, such as 25%, can be employed to determine whether the noise $Err_m$ introduced by increasing the scalefactors is too large.

The scalefactor modifier 115 is activated only after the scalefactors are generated at step 208. This ensures that higher numbers of bits are not allocated for the modified scalefactors and allows the effect of temporal masking to be taken into account.

Figure 3:
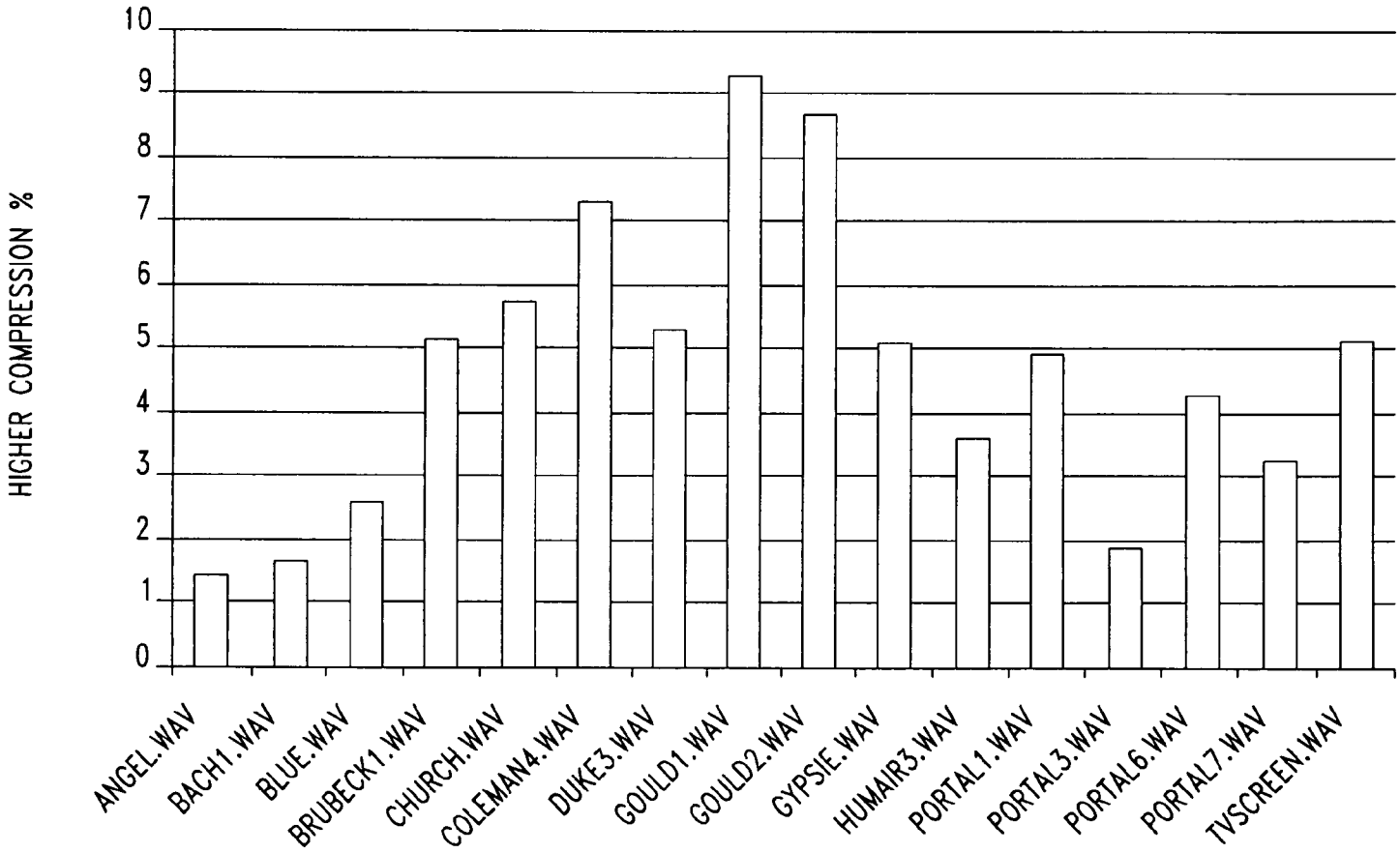
FIG. 3 is a bar chart of the increase in compression of encoded audio data generated by an embodiment of an audio encoder, such as the audio encoder illustrated in FIG. 1, over that generated by a prior art audio encoder.

The encoded audio stream 124 generated by the audio encoder 100 is compatible with any standard MPEG-1 Layer 3 decoder. In order to quantify the improved compression of the encoder, it was used to encode 17 audio files in the waveform audio '.wav' format and sizes of the resulting encoded files are compared with those for a standard MPEG Layer 3 encoder in FIG. 3. To achieve a higher compression, both encoders were tested at variable bit rates and using the lowest quality factor. FIG. 3 shows that, for the particular audio files tested, the improvement in compression produced by the audio encoder is at least 1%, and is nearly 10% in some cases. The amount of compression will, of course, depend on the number of transients present in the input audio data stream 126.

In order to assess the quality of the audio encoder, a quality-testing software program known as OPERA (Objective PERceptual Analyzer) was used. This program objectively evaluates the quality of wide-band audio signals by simulating the human auditory system. OPERA is based on the most recent perceptual techniques, and is compliant with PEAQ (Perceptual Evaluation of Audio Quality), an ITU-R standard.

Figure 4:
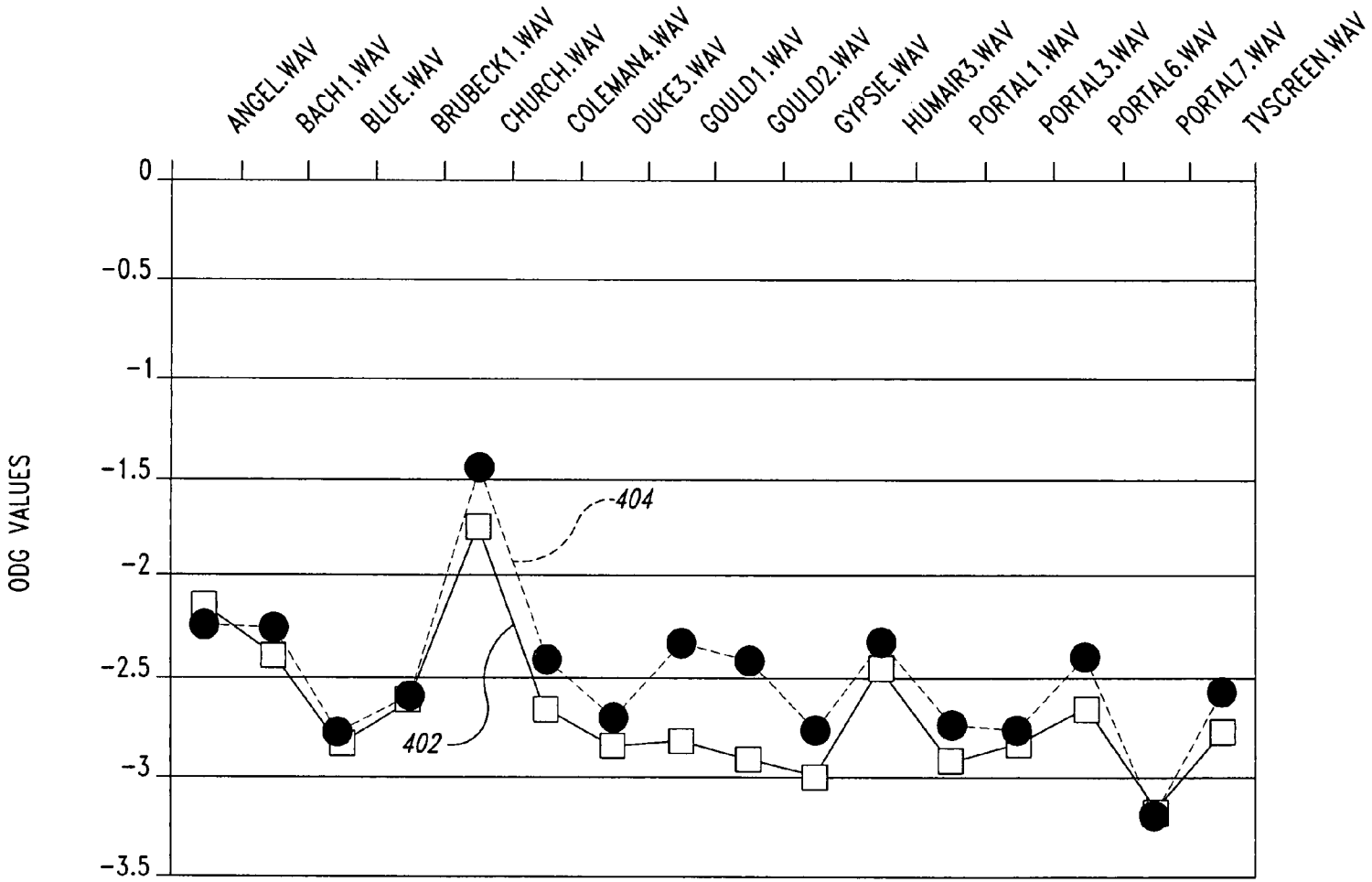
FIG. 4 is a graph comparing the quality of encoded audio data generated by an embodiment of an audio encoder, such as the audio encoder illustrated in FIG. 1, and a prior art audio encoder.

Using OPERA, the quality of the ISO MPEG-1 Layer 3 encoder was compared to that of the audio encoder 100. FIG. 4 is a graph comparing objective difference grade (ODG) values generated for each of the '.wav' files represented in FIG. 3 and the corresponding input audio data stream 126. The ODG values for the audio encoder 100 are joined by a solid line 402 and those for a standard MP3 audio encoder are shown as a dashed line 404. ODG values can range from −4.0 to 0.4, with more positive ODG values indicating better quality. A zero or positive ODG value corresponds to an imperceptible impairment, and −4.0 corresponds to an impairment judged as annoying. The tradeoff in quality due to higher compression of the audio files is apparent by the marginally more negative ODG values 402 for the audio encoder 100 compared to those 404 for the standard MP3 audio encoder.

As can be observed, files with higher compression have a marginally lower ODG value, with a typical higher compression ratio of 4-5% leading to a decrease in ODG value by only 0.16.

Although the audio encoding process described above has been described in terms of determining scalefactors for use in quantizing audio data to generate MPEG audio data, it will be apparent that alternative embodiments of the invention can be readily envisaged in which encoding errors produced by any lossy audio encoding process are allowed to increase in selected portions of audio data that are masked by temporal transients. Thus the resulting degradation in quality, which would be apparent if the encoding errors were not masked, is instead hidden from a human listener by the psychoacoustic effects of temporal masking.

Many modifications will be apparent to those skilled in the art without departing from the scope of the present invention as herein described with reference to the accompanying drawings.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A process for encoding audio data of an audio signal, including:

when a temporal masking transient is not detected in a block of audio data of an audio signal, encoding, using at least one digital signal processor or dedicated hardware component, the block of audio data as a long block of audio data; and when a temporal masking transient is detected in the block of audio data, using the at least one digital signal processor or dedicated hardware component, selectively:

generating a first encoding parameter based on a first group of samples in the block of audio data;

generating a second encoding parameter based on a second group of samples in the block of audio data;

generating a third encoding parameter based on a third group of samples in the block of audio data;

selecting a maximum encoding parameter of the first, second and third encoding parameters;

generating respective energy values for the first, second and third groups of samples;

when the respective energy values of the three groups of samples are not in ascending order, selecting the maximum encoding parameter to encode the first, second and third groups of samples;

when the respective energy values of the three groups of samples are in ascending order and a first error criteria is satisfied, selecting the maximum encoding parameter to encode the first, second and third groups of samples; and when the respective energy values are in an ascending order and the first error criteria is not satisfied, selecting the first encoding parameter to encode the first group of samples, the second encoding parameter to encode the second group of samples and the third encoding parameter to encode the third group of samples.

2. The process as claimed in claim 1 wherein the first, second and third encoding parameters are scalefactors for use in quantizing the block of audio data.

3. The process as claimed in claim 2 wherein the first error criterion is satisfied if an error value is less than a predetermined fraction of a corresponding quantization error value.

4. The process as claimed in claim 3 wherein said predetermined fraction is substantially equal to 0.3.

5. The process as claimed in claim 3 wherein said quantization error value represents a signal to noise ratio for quantization, and said error value represents a degradation of signal to noise ratio resulting from encoding using the selected maximum scalefactor.

6. The process as claimed in claim 1 wherein the process generates MPEG encoded audio data.

7. The process as claimed in claim 1 wherein the process is an MPEG-1 layer 3 audio encoding process.

8. A computer readable storage medium having stored thereon program code for causing at least one digital signal processor or dedicated hardware component to execute the steps of:

when a temporal masking transient is not detected in a block of audio data of an audio signal, encoding the block of audio data as a long block of audio data; and when a temporal masking transient is detected in the block of audio data of the audio signal, selectively:

generating a first encoding parameter based on a first group of samples in the block of audio data;

generating a second encoding parameter based on a second group of samples in the block of audio data;

generating a third encoding parameter based on a third group of samples in the block of audio data;

selecting a maximum encoding parameter of the first, second and third encoding parameters;

generating respective energy values for the first, second and third groups of samples;

when the respective energy values of the three groups of samples are not in ascending order, selecting the maximum encoding parameter to encode the first, second and third groups of samples;

when the respective energy values of the three groups of samples are in ascending order and a first error criteria is satisfied, selecting the maximum encoding parameter to encode the first, second and third groups of samples; and when the respective energy values are in an ascending order and the first error criteria is not satisfied, selecting the first encoding parameter to encode the first group of samples, the second encoding parameter to encode the second group of samples and the third encoding parameter to encode the third group of samples.

9. An audio encoder comprising:

at least one digital signal processor or dedicated hardware component configured to implement:

means for encoding a block of audio data as a long block of audio data of an audio signal when a temporal masking transient is not detected in the block of audio data; and means for selectively encoding the block of audio data as a series of three groups of data samples when a transient is detected in the block of audio data of the audio signal, comprising:

means for generating respective encoding parameters for the three groups of data samples;

means for identifying a maximum encoding parameter of the respective encoding parameters;

means for determining whether the temporal masking transient is in the third group of data samples; and means for selectively encoding the three groups of data samples using the identified maximum encoding parameter based on whether the temporal masking transient is detected in the third group of data samples and on whether an error criteria is satisfied.

10. The audio encoder of claim 9 wherein the means for determining whether the temporal masking transient is in the third group of data samples is configured to determine whether an energy level of the groups of data samples in ascending.

11. The audio encoder of claim 9 wherein the means for selectively encoding the three groups of data samples is configured to:

when respective energy values of the three groups of samples are not in ascending order, select the maximum encoding parameter to encode the three groups of samples;

when the respective energy values of the three groups of samples are in ascending order and a first error criteria is satisfied, select the maximum encoding parameter to encode the three groups of samples; and when the respective energy values are in an ascending order and the first error criteria is not satisfied, select the respective encoding parameters to encode the three groups of samples.

12. An audio encoder comprising:

at least one digital signal processor or dedicated hardware component configured to implement:

an input preprocessor to receive a block of audio data of an audio signal and to detect a presence of a temporal masking transient in the block of audio data;

psychoacoustic modeling circuitry coupled to the input preprocessor to generate masking data related to the block of audio data; and iteration loop circuitry, wherein the audio encoder is configured to:

encode the block of data as a long block when a temporal masking transient is not detected in the block of audio data;

encode the block of data as three short blocks in series using a maximum encoding parameter associated with the three short blocks when a temporal masking transient is detected in the block of audio data and an error criteria is satisfied; and encode the block of data as three short blocks in series using respective encoding parameters associated with the three short blocks when a temporal masking transient is detected in the block of audio data and the error criteria is not satisfied.

13. The audio encoder of claim 12 wherein the iteration loop circuitry comprises a scalefactor modifier.

14. The encoder of claim 12 wherein the iteration loop is configured to determine whether the error criteria is satisfied based on whether an energy level of the three short blocks is in ascending order and on whether a distortion level exceeds a threshold.

* * * * *